US008118297B2

(12) United States Patent
Izumichi

(10) Patent No.: US 8,118,297 B2
(45) Date of Patent: Feb. 21, 2012

(54) SHEET FEEDER AND IMAGE FORMING APPARATUS WITH SIDE SURFACE AIR MECHANISM

(75) Inventor: Sachio Izumichi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/005,726

(22) Filed: Jan. 13, 2011

(65) Prior Publication Data

US 2011/0109036 A1 May 12, 2011

Related U.S. Application Data

(63) Continuation of application No. 12/552,123, filed on Sep. 1, 2009, now Pat. No. 7,891,654.

(30) Foreign Application Priority Data

Nov. 10, 2008 (JP) ..... 2008-287634

(51) Int. Cl.
*B65H 1/08* (2006.01)

(52) U.S. Cl. ..... 271/30.1; 271/97; 271/128

(58) Field of Classification Search ..... 271/128, 271/97, 30.1
See application file for complete search history.

(56) References Cited

U.S. PATENT DOCUMENTS

| | | | | |
|---|---|---|---|---|
| 4,925,177 | A * | 5/1990 | Nakamura et al. | 271/127 |
| 6,182,962 | B1 * | 2/2001 | Leuthold | 271/128 |
| 6,290,225 | B1 | 9/2001 | Linder et al. | |
| 6,609,708 | B2 * | 8/2003 | Moore et al. | 271/98 |
| 7,938,396 | B2 * | 5/2011 | Okumura et al. | 271/128 |
| 2010/0289209 | A1 * | 11/2010 | Clark et al. | 271/157 |

FOREIGN PATENT DOCUMENTS

| | | |
|---|---|---|
| JP | 2003-312874 | 11/2003 |
| JP | 2005-104723 | 4/2005 |

* cited by examiner

*Primary Examiner* — Gerald McClain
(74) *Attorney, Agent, or Firm* — McDonnell Boehnen Hulbert & Berghoff LLP

(57) ABSTRACT

A sheet feeding unit includes a side warm-air mechanism that blows air toward a side surface of a sheet stack S from a warm-air outlet. The sheet feeding unit controls the lift mechanism so as to perform a sheet separating operation every time a predetermined number of sheets P are fed during a continuous sheet feeding operation.

13 Claims, 13 Drawing Sheets

【FIG.1】
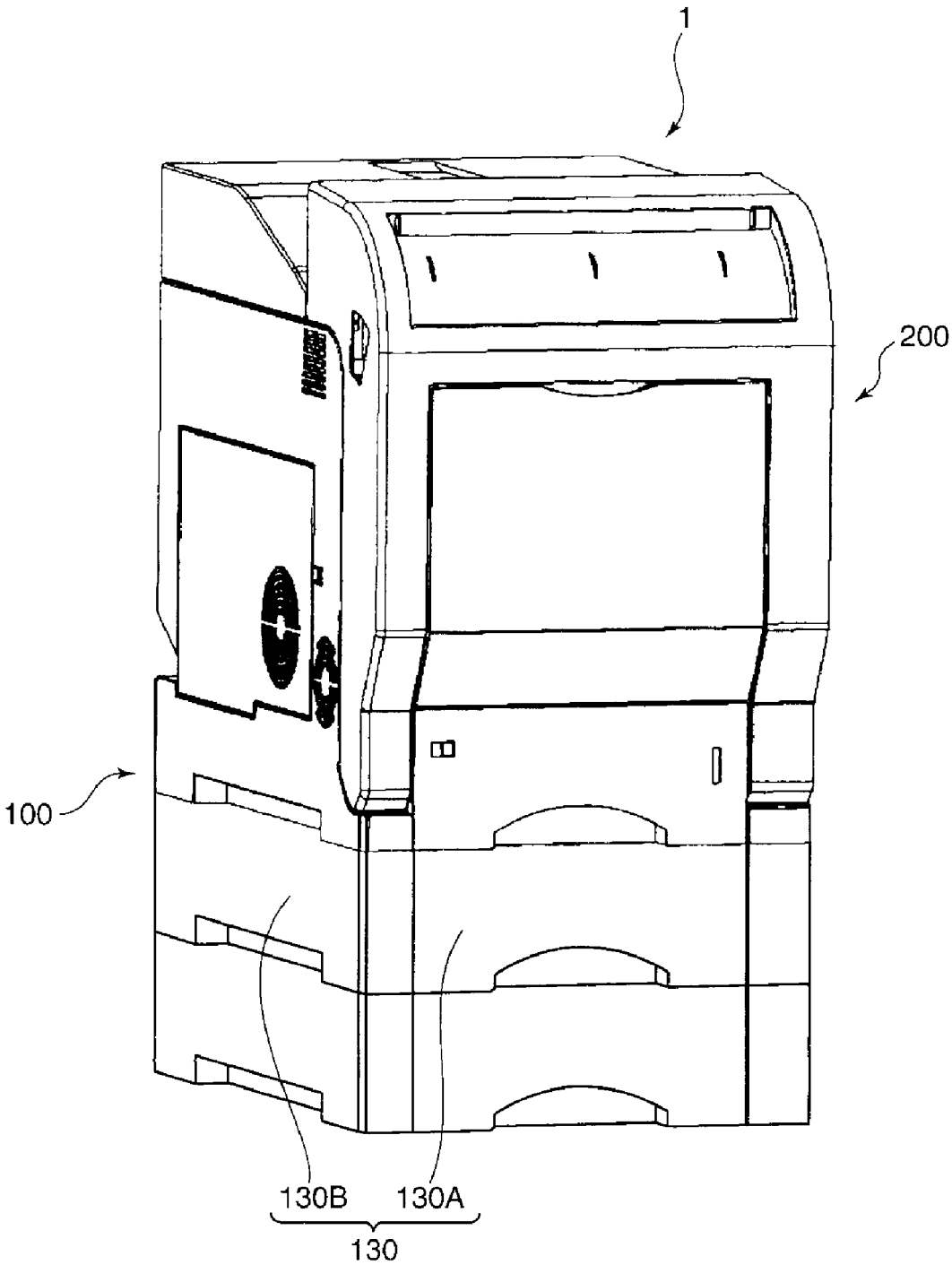

【FIG.2】
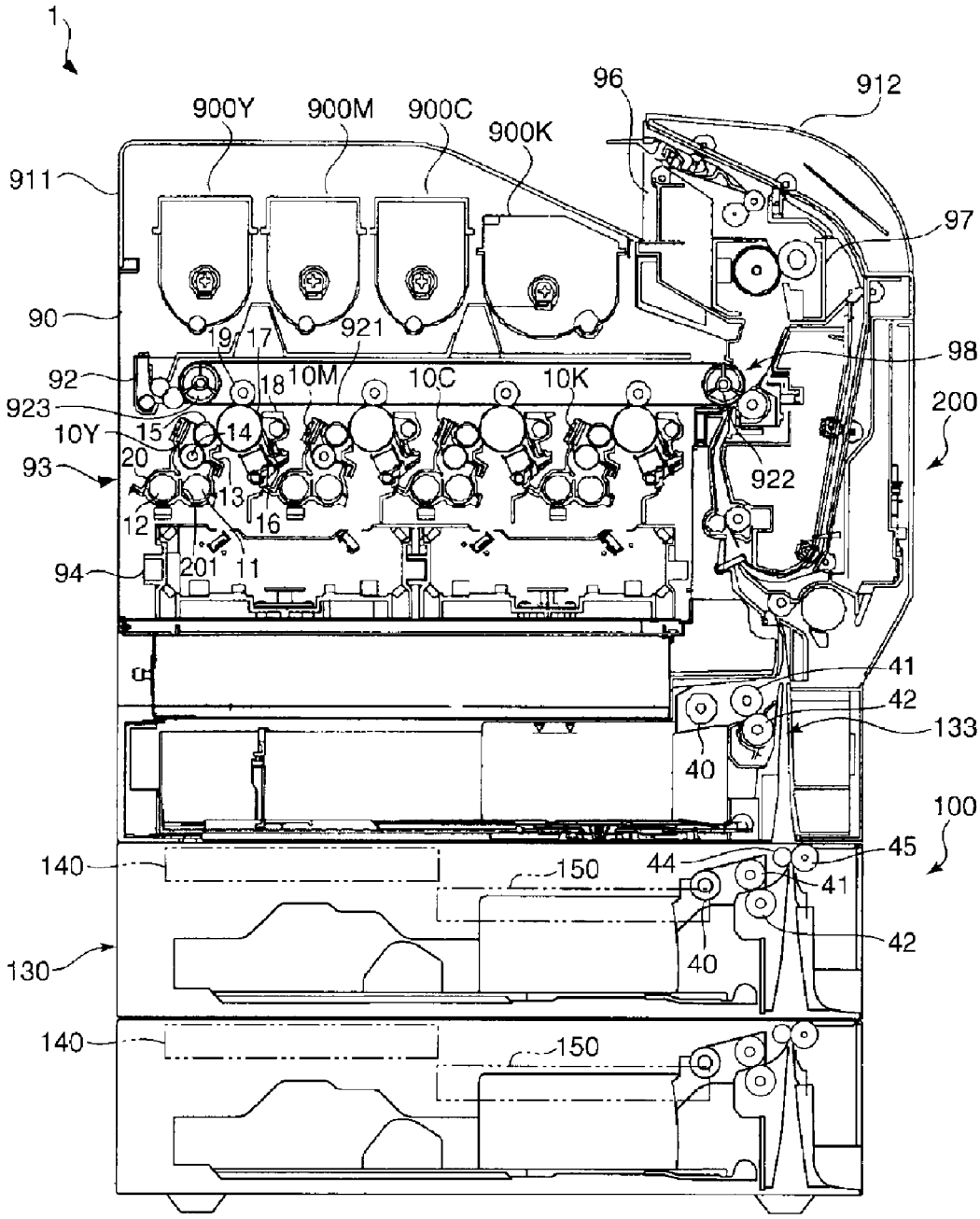

【FIG3】
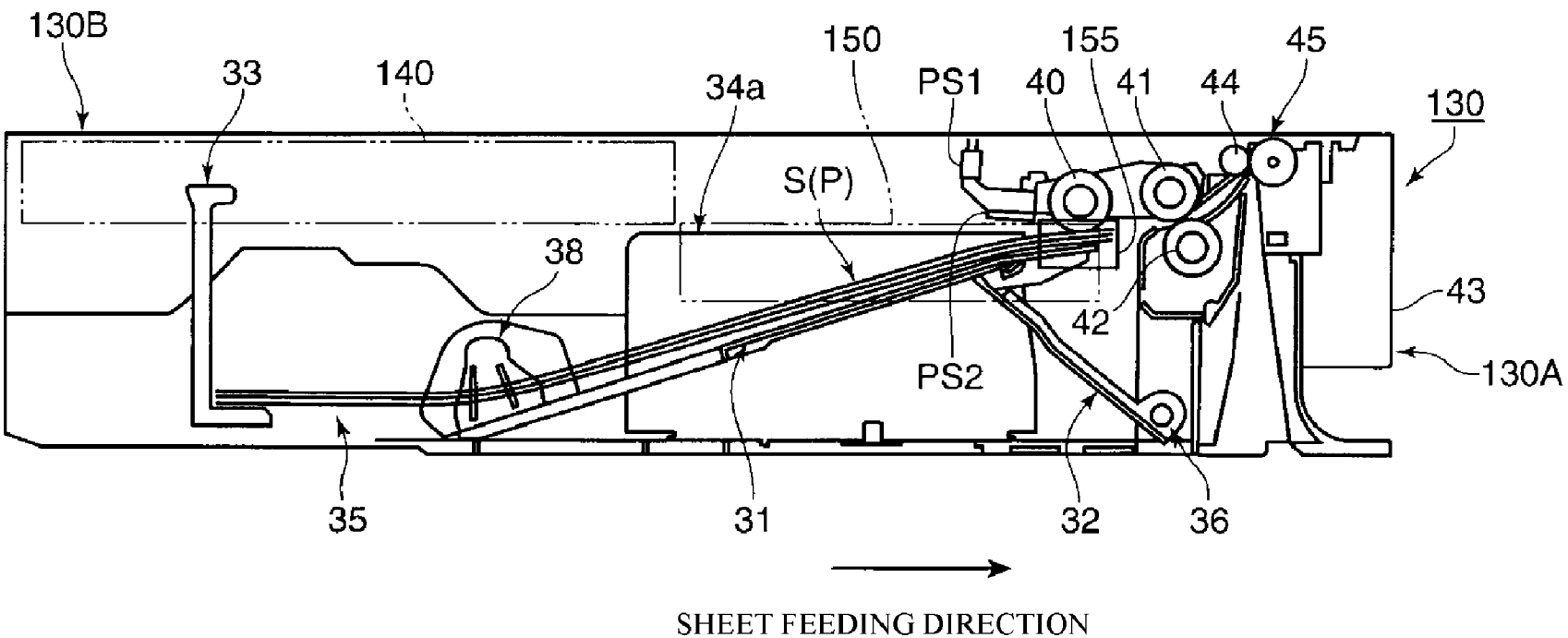

【FIG4】
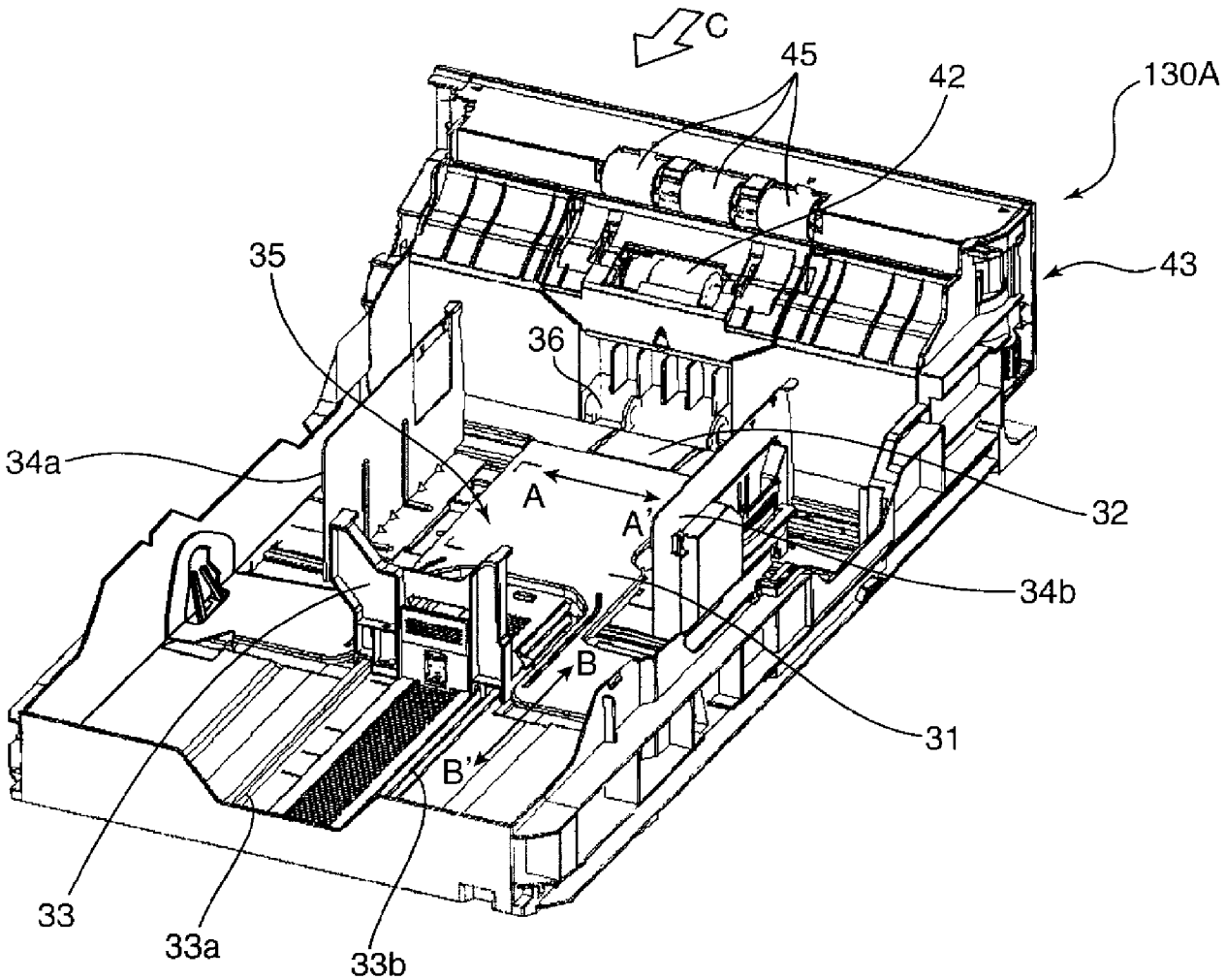

[FIG.5]
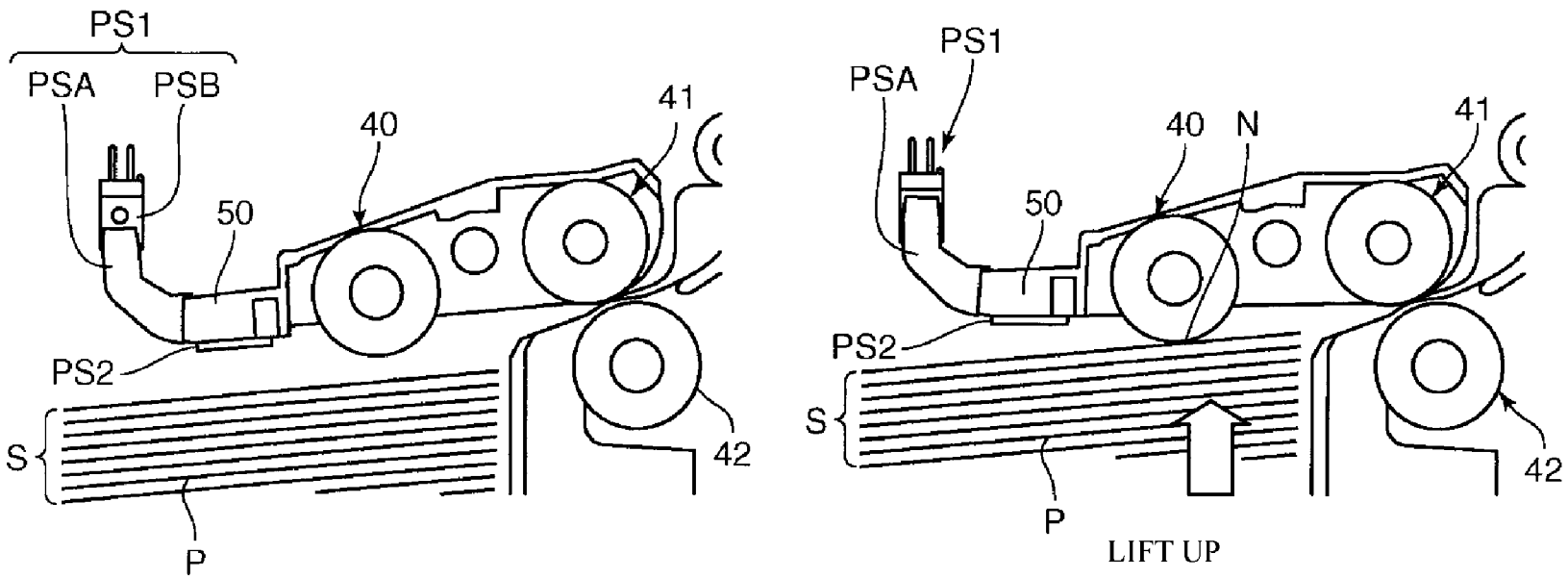

[FIG6]
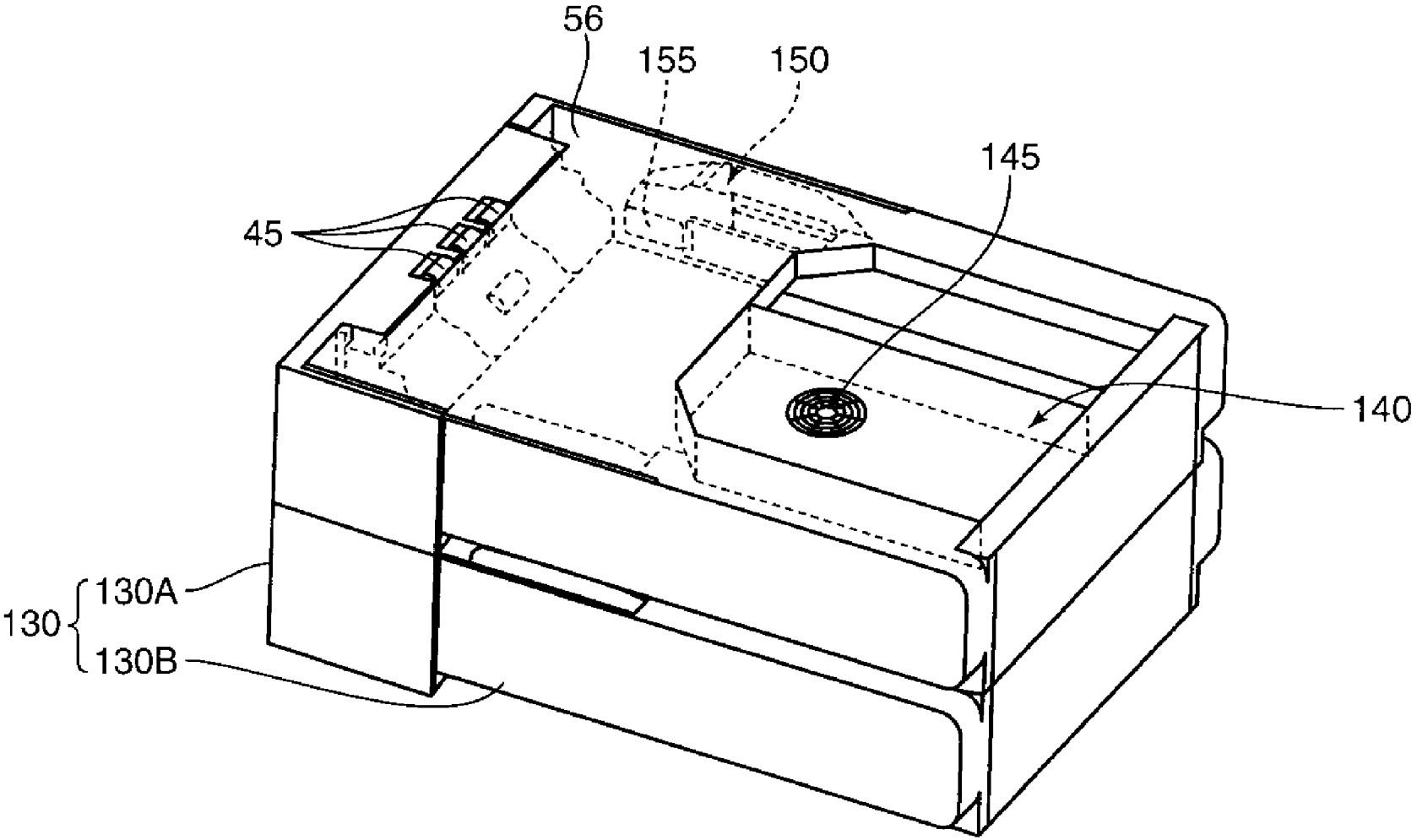

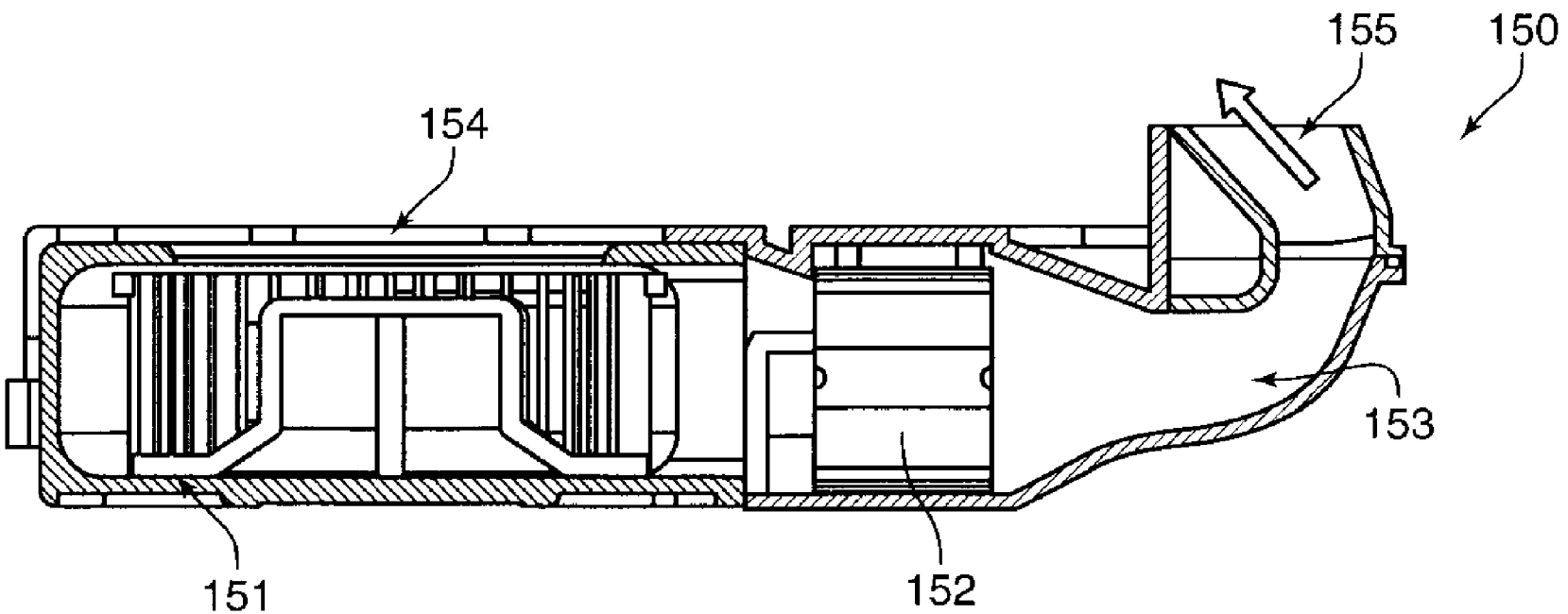
[FIG 7]

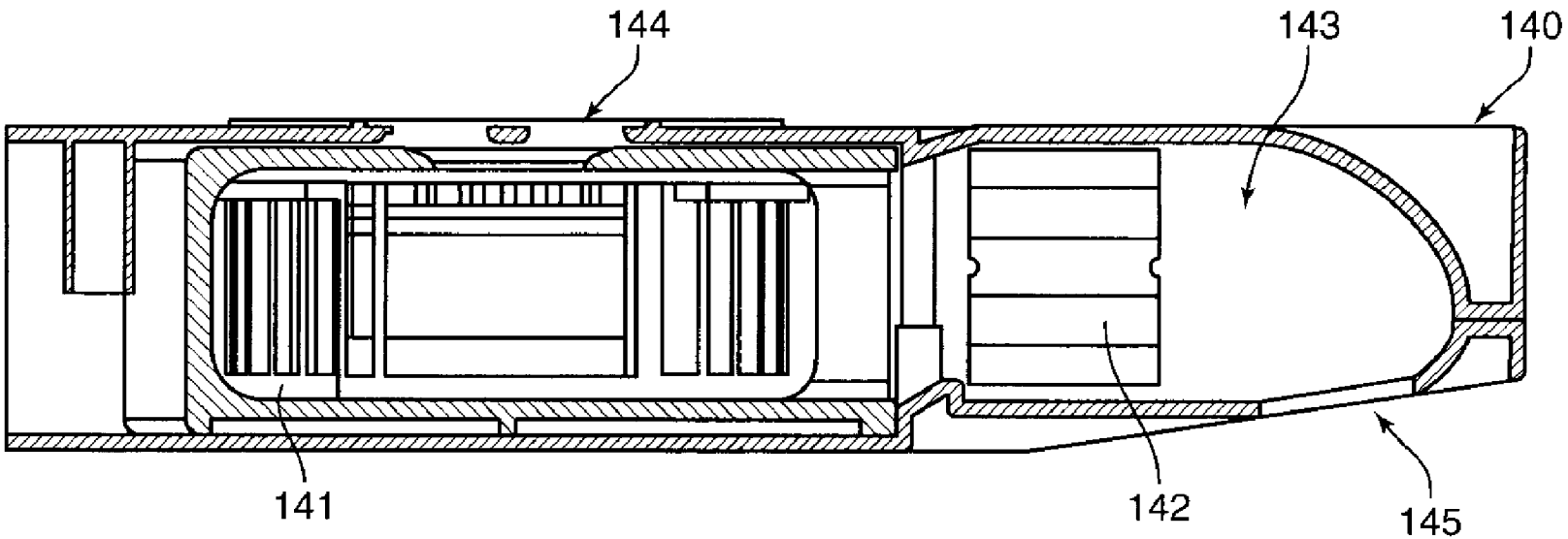
【FIG.8】

[FIG9]
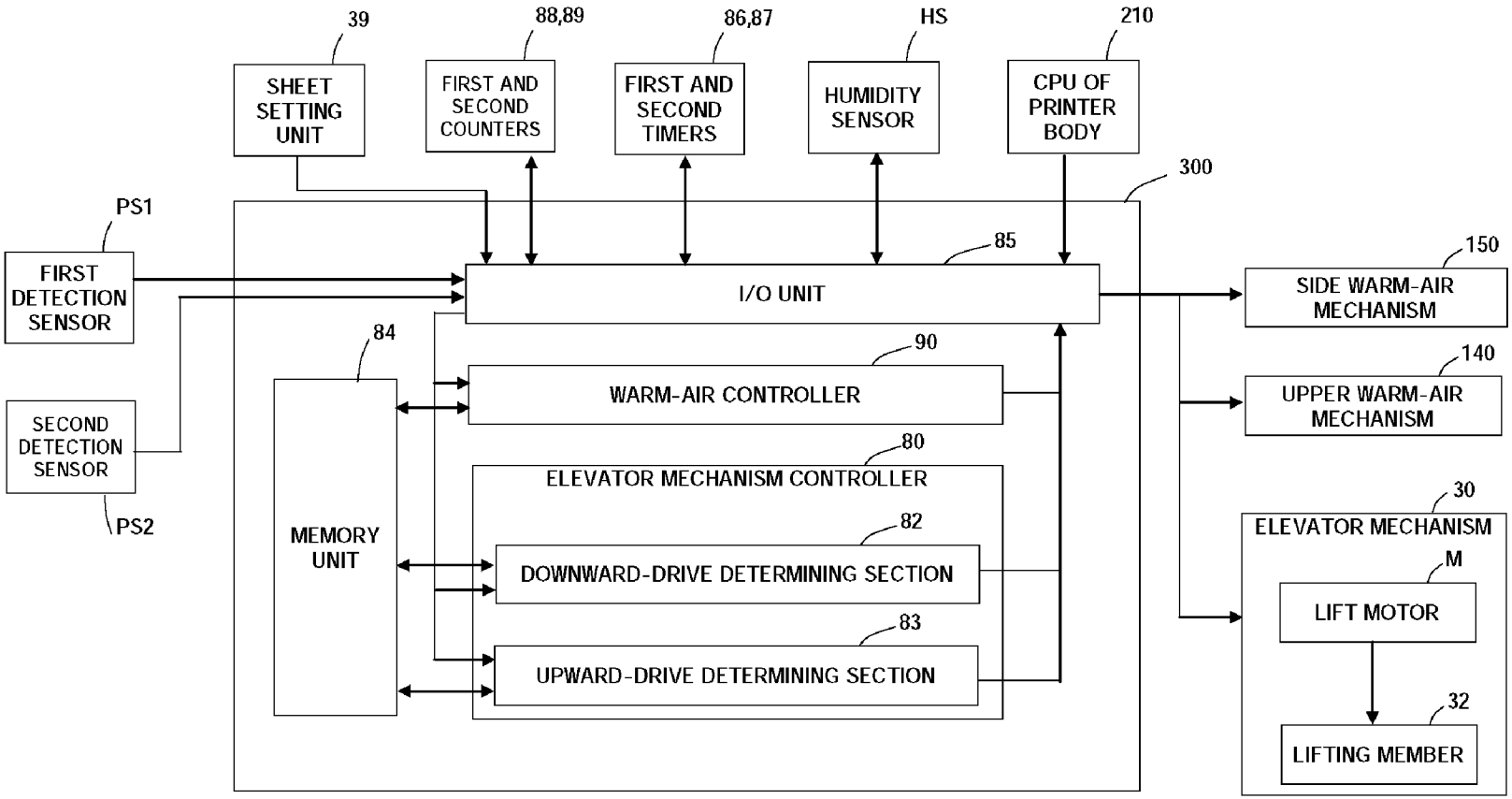

[FIG 10]
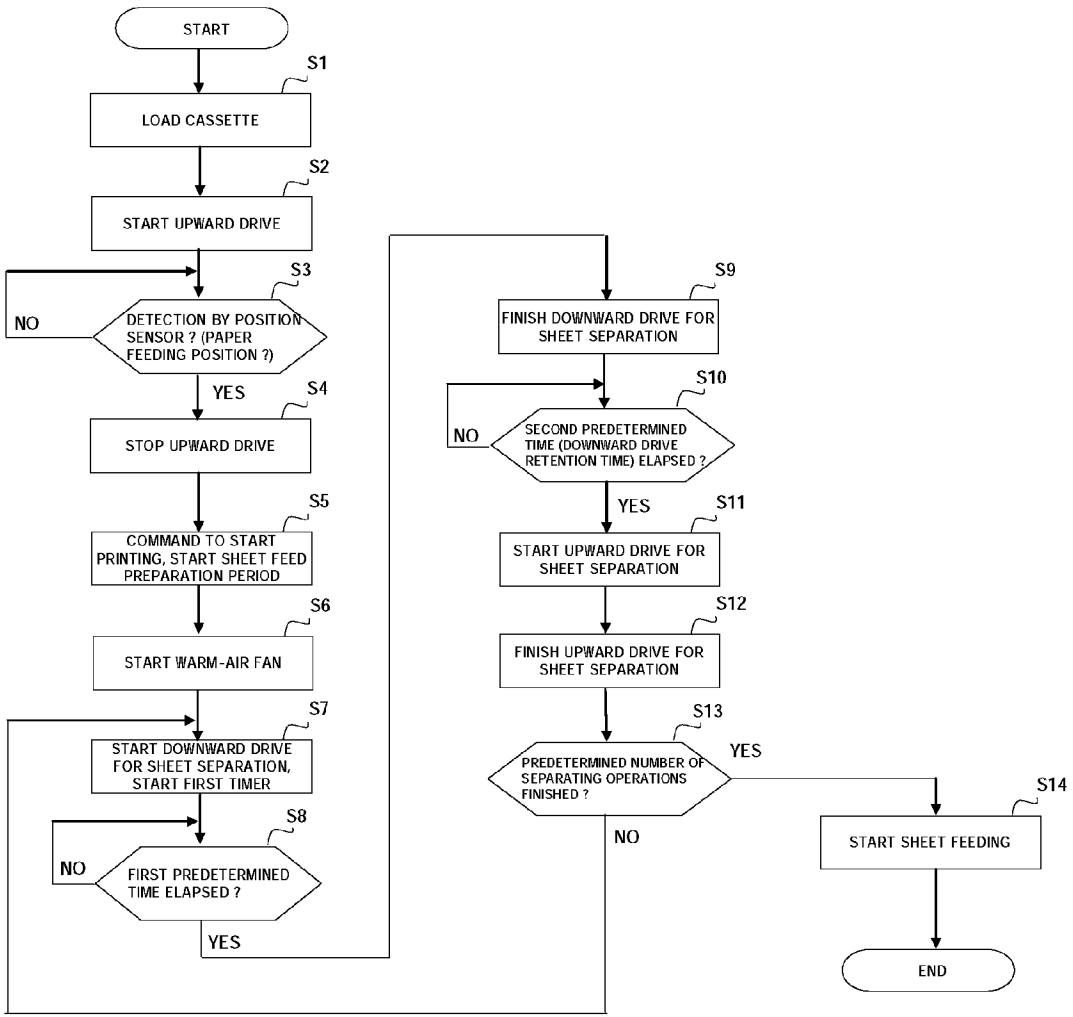

【FIG.11】
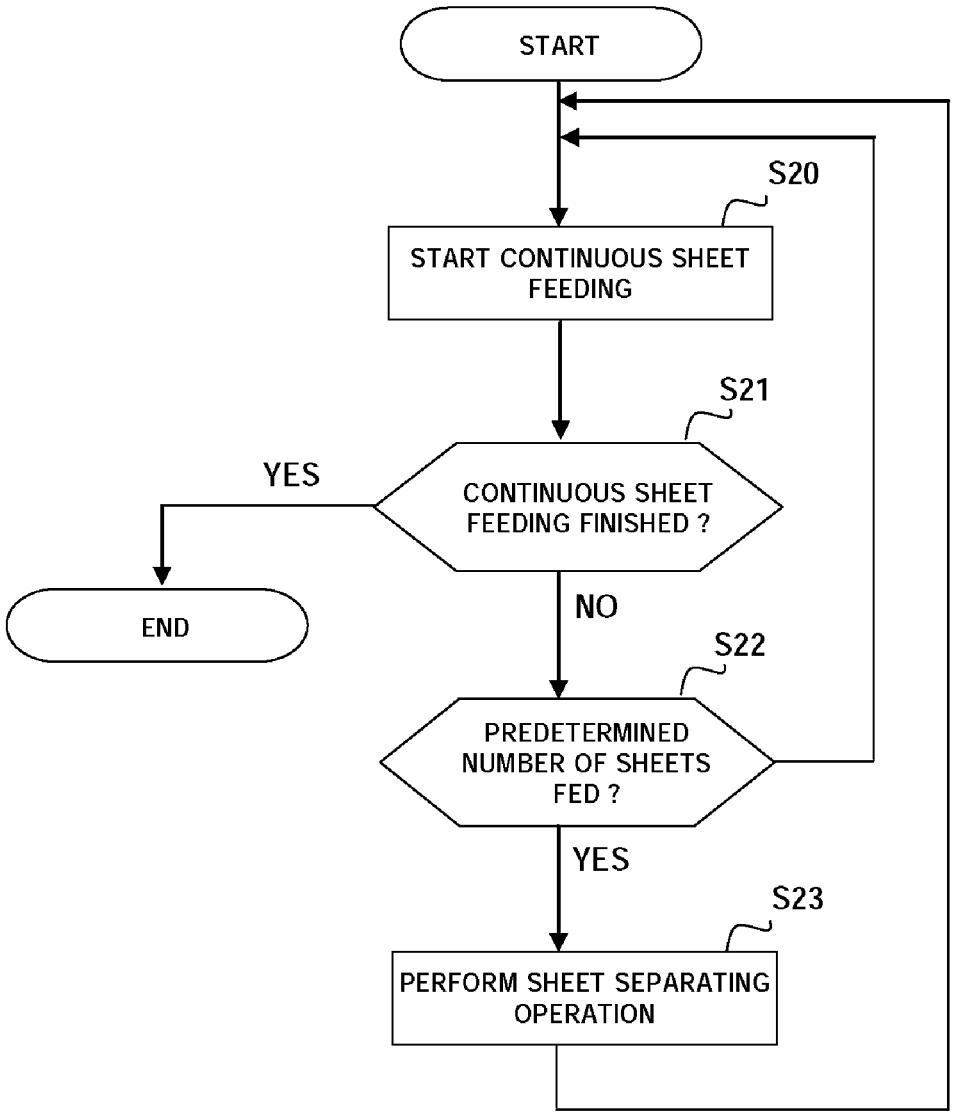

【FIG.12】
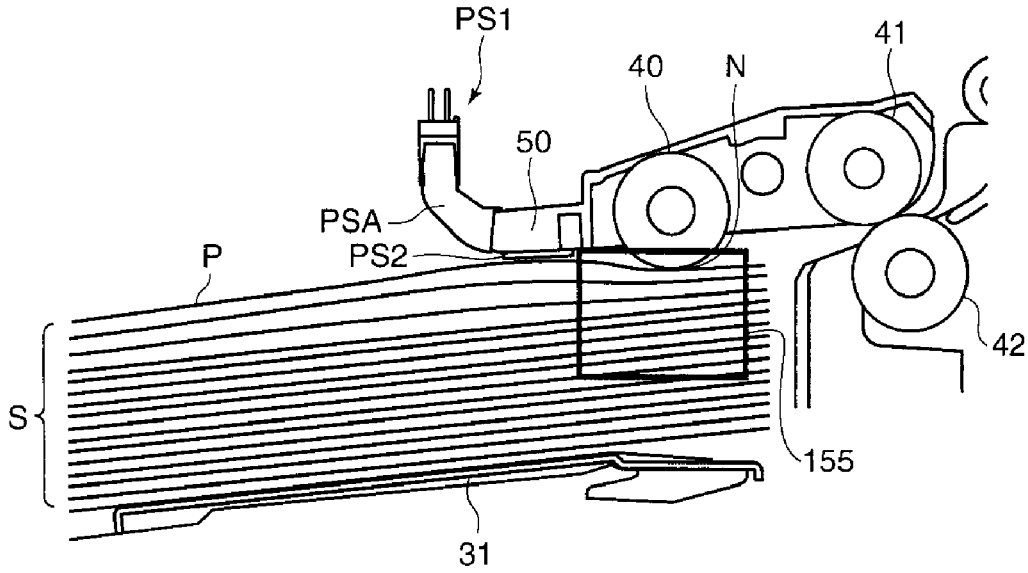
【FIG.13】
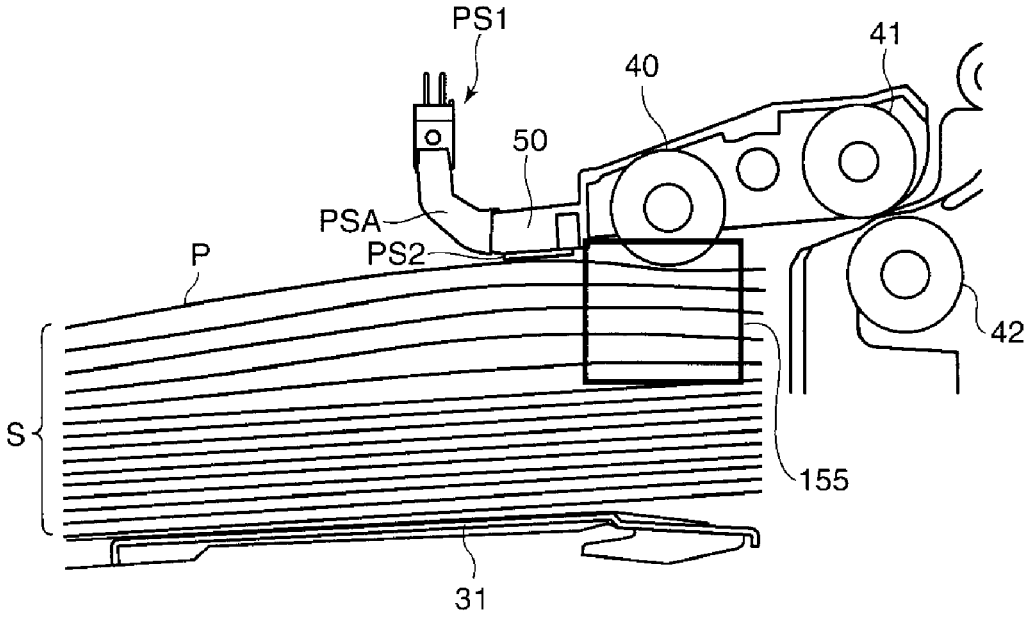

【FIG.14】
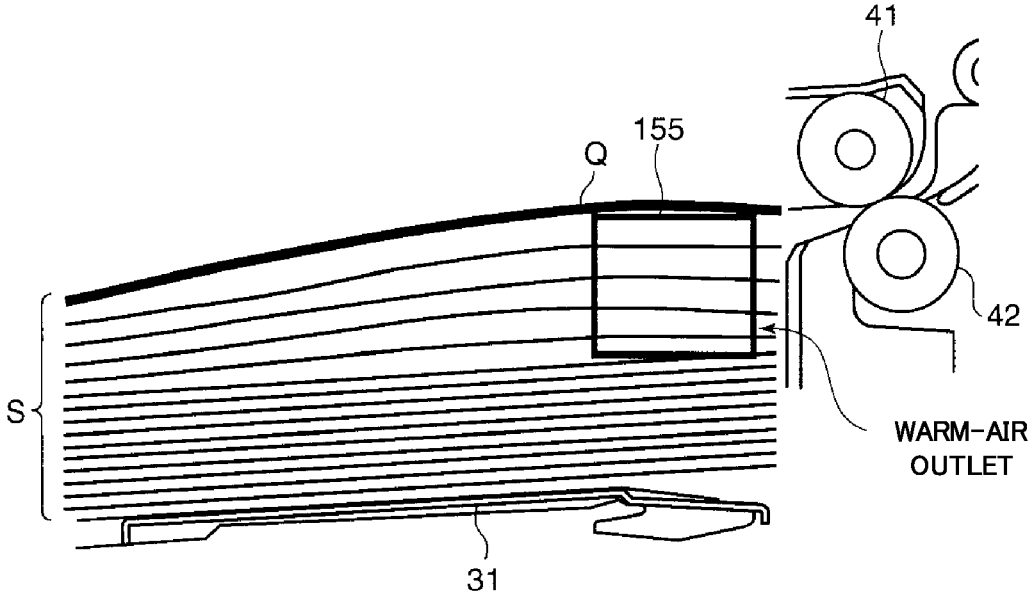

SHEET FEEDER AND IMAGE FORMING APPARATUS WITH SIDE SURFACE AIR MECHANISM

The present invention is a continuation application of U.S. patent application Ser. No. 12/552,123 filed in the U.S. Patent Office on Sep. 1, 2009, which itself claims priority to Japanese Patent Application JP 2008-287634 filed in the Japanese Patent Office on Nov. 10, 2008, the entire contents of both of which are incorporated herein by reference.

BACKGROUND OF THE INVENTION

1. Field of the Invention

The present invention relates to a sheet feeder used for an image forming apparatus such as a printer, a copier, a fax machine, or a multi-functional peripheral incorporating these functions. The present invention also relates to an image forming apparatus including the sheet feeder.

2. Description of the Related Art

To date, only sheets of high-quality paper, plain paper specified by copier manufacturers, or the like have been used as sheet recording medium that can be continuously fed in image forming apparatuses such as printers, copiers, and fax machines. Such sheets of high-quality paper, plain paper, or the like have low surface smoothness, whereby their inter-sheet adhesion is comparatively low. Thus, it has been comparatively easy to prevent double feeding that may occur when the cut sheets are fed out one at a time from a sheet loading section such as a sheet feed tray. The term "double feeding" refers to a phenomenon in which a plurality of cut sheets adhering to each other are simultaneously fed out. Moreover, even if double feeding occurs when such cut sheets are used, it is possible to separate doubly fed cut sheets by providing a separation roller, a separation pad, a separation claw, or the like to the sheet feeder so that the cut sheets can be smoothly fed one at a time.

However, the sheet recording medium has become diversified in recent years. Sheets having a low surface smoothness such as high-quality paper, plain paper, or the like are not the only sheets used as sheet recording medium. In particular, as the colorization technology for image forming apparatuses has improved, a paper having a high surface smoothness such as a coating paper can now be used. A coating paper is composite paper of which one or both sides are coated with a coating color, which is a coating material, so as to improve printability. A coating paper has a high whiteness and gloss. Thus, in recent years, demand has been increasing for feeding not only high-quality paper and plain paper, but also the above-described coating paper, film sheets, tracing paper, and the like in an image forming apparatus. Because coating paper, film sheet, tracing paper, and the like have a high adhesion between papers, it is difficult to prevent double feeding of such sheets. Therefore, it is necessary to introduce special measures in order to feed (in particular, to feed out) such sheets.

Moreover, a stack of sheets loaded on a sheet loading section is prone to absorb moisture because the upper surface and the outer periphery of the stack of sheets are exposed to the air outside. The upper surface and the side surfaces of the stack of sheets absorb moisture and swell, while the inside of the sheet stack swells to a lesser extent because the inside absorbs less moisture than the upper surface and the side surfaces. As a result, inner spaces of the sheet stack (spaces between sheets) enter a negative pressure state, which causes the sheets to adhere to each other.

In order to reduce adhesion between sheets and separate the sheets in a sheet stack before feeding the sheets, some large copiers and the like adopt sheet feeders including mechanisms (hereinafter referred to as "side warm-air assists") for blowing warm air toward side surfaces of sheet stack.

For example, there is a known technique that increases the efficiency of sheet separation while fulfilling the requirement for reduction in size and power consumption. With this technique, movement speed of an air shielding member, which serves to partially close an opening through which blowing means blows air from an outlet thereof toward a side surface of a sheet stack, is changed so that air is effectively blown toward an upper part of the sheet stack.

However, with this sheet separation technique, for example, while a large number of sheets are being continuously fed, sheets in a lower part of a sheet stack may be fed without being separated and may cause jamming. This problem is particularly serious when art paper or coated paper, which has high inter-sheet adhesion, is used in a high-humidity environment.

SUMMARY OF THE INVENTION

The present invention, which has been achieved against the above-described background, provides a sheet feeder including a sheet separation mechanism that securely prevents jamming even when continuous feeding of sheets with high inter-sheet adhesion is performed, and an image forming apparatus including the sheet feeder.

A sheet feeder according to an aspect of the present invention includes a sheet loading plate for loading a stack of sheets thereon, a sheet feed mechanism capable of performing a continuous sheet feeding operation from an uppermost sheet in the stack on the sheet loading plate, a warm-air mechanism blowing air toward a side surface of the stack from an outlet, where the side surface is parallel to a sheet feeding direction, a lift mechanism displacing the sheet loading plate, and a controller controlling a sheet separating operation to perform every time a predetermined number of the sheets are fed during the continuous sheet feeding operation.

In the sheet separating operation, the lift mechanism displaces the sheet loading plate by while the warm-air mechanism blows warm air is blown to the side surface of the sheet stack.

Therefore, the sheet feeder is provided with a sheet separation mechanism that can securely prevent double feeding by separating sheets every time a predetermined number of sheets are fed during a continuous sheet feeding operation. This occurs even when sheets that are made of, for example, a paper having a high inter-sheet adhesion and a susceptibility to double-feeding, such as an art paper or a coated paper, are continuously fed.

It is preferable that the sheet feeder may further include a sheet identifying unit that identifies a type of sheet to be fed. The controller then determines whether or not to perform the sheet separating operation corresponding to the type of the sheet identified by the sheet identifying unit.

It is preferable that the sheet feeder may further include a sheet identifying unit that identifies a type of the sheet to be fed, with the controller changing the predetermined number corresponding to the type of sheet identified by the sheet identifying unit and carrying out control so as to perform the sheet separating operation.

It is preferable that the sheet feeder may further include a float amount detector that detects a float amount by which the sheet is floated when warm air is blown from the outlet. The controller may determine whether or not to perform the sheet separating operation corresponding to the float amount of the sheet detected by the float amount detector. In addition, the controller may change the predetermined number corresponding to the float amount of the sheet detected by the float amount detector and perform the sheet separating operation.

It is preferable that the lift mechanism of the sheet feeder may include a lifting member that lifts up the sheet loading plate. The sheet loading plate may be rotatably supported at an end thereof, the end being in an upstream side of the sheet loading plate with respect to the sheet feeding direction. The lifting member may be configured such that an end thereof is rotatably supported by a drive shaft and the other end thereof contacts the bottom surface of the sheet loading plate so as to lift up the sheet loading plate.

An image forming apparatus according to another aspect of the present invention includes a sheet feeder having any of the above-described configurations, and an image forming apparatus body that forms images on the sheets fed by the sheet feeder.

Since the image forming apparatus includes a sheet feeder having any of the above-described configurations, jamming can be effectively prevented even when a continuous feeding operation using sheets having a high inter-sheet adhesion is performed under a high humidity environment.

The present invention provides a sheet feeder that effectively prevents jamming even when a continuous feeding operation using sheets with high inter-sheet adhesion is performed, and an image forming apparatus including the sheet feeder.

BRIEF DESCRIPTION OF THE DRAWINGS

FIG. 1 is an external perspective view of a printer including a sheet feeder according to an embodiment of the present invention;

FIG. 2 is a sectional view showing an internal structure of the printer shown in FIG. 1;

FIG. 3 is a sectional view showing a structure of a sheet feeder according to an embodiment of the present invention;

FIG. 4 is a perspective view of a sheet feed cassette of the sheet feeder shown in FIG. 3 in a state in which the sheet feed cassette has been pulled out from the body of the sheet feeder;

FIGS. 5A and 5B are explanatory views showing position detection sensors incorporated in the sheet feeder shown in FIG. 3;

FIG. 6 is an explanatory view showing a structure of a sheet feeder according to an embodiment of the present invention;

FIG. 7 is a horizontal sectional view of a main part of a side warm-air mechanism incorporated in the sheet feeder shown in FIG. 6;

FIG. 8 is a vertical sectional view of a main structure of an upper warm-air mechanism incorporated in the sheet feeder shown in FIG. 3;

FIG. 9 is a functional block diagram of a controller, which controls a warm-air blowing operation including a separating operation, according to an embodiment of the present invention;

FIG. 10 is a flowchart showing a control process exercised by the controller shown in FIG. 9;

FIG. 11 is a flowchart showing another control process exercised by the controller shown in FIG. 9;

FIG. 12 is a longitudinal sectional view of a main part of a sheet feeding unit according to an embodiment of the present invention;

FIG. 13 is a longitudinal sectional view of a main part of a sheet feeding unit according to an embodiment of the present invention; and FIG. 14 is a longitudinal sectional view of a main part of a sheet feeding unit according to an embodiment of the present invention.

DESCRIPTION OF THE PREFERRED EMBODIMENTS

First Embodiment

Referring to FIGS. 1 and 2, an image forming apparatus including a sheet feeder according to an embodiment of the present invention is described.

FIG. 1 is an external perspective view of an image forming apparatus including a sheet feeder according to an embodiment of the present invention. FIG. 2 is a sectional view showing an internal structure of the image forming apparatus.

As shown in FIG. 1, a color printer 1, which is an image forming apparatus according to an embodiment of the present invention, includes a printer body 200 and a sheet supply section 100. The printer body 200 is connected to a personal computer (PC) (not shown), or the like, directly or through a Local Area Network (LAN). The sheet supply section 100, which is disposed below the printer body 200, can separately hold sheets P in different trays corresponding to the size. The color printer 1 includes other components used in a general color printer, such as a control circuit for controlling operation of the color printer 1.

As shown in FIG. 2, the printer body 200 includes toner containers 900Y, 900M, 900C, 900K, an intermediate transfer unit 92, an image forming unit 93, an exposure unit 94, a fusing unit 97, a sheet ejection unit 96, a housing 90 of the printer body, a top cover 911, and a front cover 912.

The image forming unit 93 includes and developing units 10Y, 10M, 10C, and 10K respectively for yellow, magenta, cyan, and black, disposed below the toner containers.

The image forming unit 93 further includes photosensitive drums 17 (photosensitive members on which latent images are formed by electrophotography) that bear toner images of respective colors. Photosensitive material of the photosensitive drums made of an amorphous silicon (a-Si) material can be used as the photosensitive drums 17. Toners of yellow, magenta, cyan, and black colors are supplied to the photosensitive drums 17 from the corresponding developing units 10Y, 10M, 10C, and 10K.

As described above, the image forming unit 93 in this embodiment is capable of forming full-color images. However, an embodiment is not limited thereto, and an image forming unit that forms black-and-white images or non-full-color color images may be used.

Around the photosensitive drums 17, chargers 16, developing units 10 (10Y, 10M, 10C, and 10K), transfer units (transfer rollers) 19, cleaning units 18, and the like are disposed. The chargers 16 uniformly charge surfaces of the photosensitive drums 17. The charged surfaces of the photosensitive drums 17 are exposed by the exposure unit 94 so that electrostatic latent images are formed thereon. The developing units 10Y, 10M, 10C, and 10K respectively develop (make visible) the electrostatic latent images formed on the photosensitive drums 17 using toner of the corresponding colors supplied from the toner containers 900Y, 900M, 900C, and 900K. The transfer rollers 19 and the photosensitive drums 17 nip intermediate transfer belts 921 so as to primarily transfer the toner images formed on the photosensitive drums 17 onto the intermediate transfer belt 921. After the toner images have been transferred, the cleaning units 18 clean the peripheral surfaces of the photosensitive drums 17.

Each of the developing units 10Y, 10M, 10C, and 10K includes a case 20 that contains a two-component developer including magnetic carrier and toner. Near the bottom of the case 20, two stirring rollers 11 and 12 (developer stirring members) are disposed in parallel in such a manner that each of the stirring rollers 11 and 12 are rotatable around the longitudinal axis thereof.

A developer circulation path is made along the inner bottom of the case 20, and the stirring rollers 11 and 12 are disposed in the circulation path. A partition wall 201 stands between the stirring rollers 11 and 12 so as to extend in the axis direction of the stirring rollers 11 and 12. The partition wall 201 divides the circulation path so that the circulation path surrounds the partition wall 201. The two-component developer is charged while the two-component developer is stirred and transported by the stirring rollers 11 and 12 along the circulation path.

The two-component developer circulates in the case 20 while the two-component developer is being stirred by the stirring rollers 11 and 12 so that the toner is charged, and the two-component developer on the stirring roller 11 is attracted to a magnetic roller 14 disposed above the stirring roller 11 and transported onto the magnetic roller 14. The two-component developer attracted to the magnetic roller 14 forms a magnetic brush (not shown) on the magnetic roller 14. The thickness of the magnetic brush is regulated by a doctor blade 13, and a toner layer is formed on a developing roller 15 due to an electrical potential difference between the magnetic roller 14 and the developing roller 15. Using the toner layer on the developing roller 15, the electrostatic latent image on the photosensitive drum 17 is developed.

The exposure unit 94 includes various optical devices, such as a light source, polygon mirrors, reflection mirrors, and deflection mirrors. The exposure unit 94 irradiates peripheral surfaces of the photosensitive drums 17 disposed in the image forming unit 93 with light corresponding to the image data, so that the electrostatic latent images are formed on the photosensitive drums 17.

The intermediate transfer unit 92 includes the intermediate transfer belt 921, a drive roller 922, and a driven roller 923. Toner images are primarily transferred from the photosensitive drums 17 onto the intermediate transfer belt 921 in an overlapping manner. A secondary transfer unit 98 secondarily transfers the toner images onto the sheet P that is supplied by a sheet feeding unit 130. The drive roller 922 and the driven roller 923 rotate the intermediate transfer belt 921. The drive roller 922 and the driven roller 923 are rotatably supported by a case (not shown).

The sheet feeding unit 130 stores a sheet stack including the sheets P on which images are to be formed. The sheet feeding unit is detachably loaded into the housing 90.

The fusing unit 97 fuses the toner images that have been secondarily transferred onto the sheet P conveyed from the intermediate transfer unit 92. After a color image has been fixed on the sheet P, the sheet P is conveyed to the sheet ejection unit 96 disposed in an upper part of the printer body 200.

The sheet ejection unit 96 ejects the sheet P that has been conveyed from the fusing unit 97 onto the top cover 911 serving as a sheet ejection tray.

The sheet supply section 100 includes a sheet feeder fixed to the printer body 200 and a plurality (in this embodiment, two) of the sheet feeding units (sheet feeders) 130 that are stacked on top of each other and removably loaded on the printer body 200. Several sizes of the sheet stacks S are respectively stored in the sheet feeding units 130. When one of the sheet feeding units 130 is selected, a pickup roller 40 disposed in the sheet feeding unit 130 is rotated so that the uppermost sheet P in the sheet stack S is picked up, fed out to a sheet conveying path 133, and transported into the image forming unit 93.

Each of the sheet feeding units 130 includes a conveying mechanism that can be mounted as an option to the bottom portion of the printer body 200 in a stacking manner, so that a desired number of the sheet feeding units 130 can be optioned to the printer body 200. By thus stacking the sheet feeding units 130 under the printer body 200, the transport mechanisms of the sheet feeding units 130 are connected to each other, so that the sheet conveying path 133 extending to the printer body 200 is formed. In this manner, the sheet feeding units 130 can be optioned to the printer body 200 in a stacking manner.

In the embodiment, the sheet supply section 100 includes three sheet feeding units 130. However, the present invention is not limited thereto, and also applicable to an image forming apparatus, such as a printer, having the sheet supply section 100 including one, two, four, or more sheet feeding units 130.

Referring to FIGS. 1, 3, and 5, the structure of the sheet feeding unit (sheet feeder) 130 according to the embodiment, which is disposed into the sheet supply section 100 of the color printer 1, is described in detail.

FIG. 3 is a sectional view showing a structure of the sheet feeder according to the embodiment. FIG. 4 is a perspective view of a sheet feed cassette of the sheet feeder shown in FIG. 3 in a state in which the sheet feed cassette has been pulled out from the body of the sheet feeder. FIG. 5 is an explanatory view showing position detection sensors incorporated in the sheet feeder shown in FIG. 3.

As shown in FIGS. 3 and 4, the sheet feeding unit 130 includes a lift plate (sheet loading plate) 31 disposed on an inner bottom surface of a sheet container 35. A sheet stack S including a plurality of sheets (sheet recording medium) P is placed on the lift plate 31. The lift plate 31 is rotatably supported by supporting sections 38 at an upstream end thereof (left end in FIG. 3) with respect to the sheet feeding direction. That is, the lift plate 31 is supported by the supporting sections 38 so that the lift plate is vertically rotatable in the sheet container 35 with a downstream end thereof acting as a free end. The supporting sections 38 are disposed on both side walls of the sheet container 35 disposed opposite each other in the width direction of the sheet P (the direction perpendicular to the sheet feeding direction).

A sheet feeding cassette 130A of the sheet feeding unit 130 includes a pair of width-adjusting cursors 34*a* and 34*b* for positioning the sheets P in the sheet container 35 in the width direction, and a back-end cursor 33 for aligning back ends of the sheets P. The pair of width-adjusting cursors 34*a* and 34*b* are disposed so as to be reciprocally movable in the sheet width directions (shown by arrow AA' in FIG. 4) along a guide rail (not shown). The back-end cursor 33 is disposed so as to be reciprocally movable in directions parallel to the sheet feeding direction (shown by arrow BB' in FIG. 4) along guide rails 33*a* and 33*b* so that the sheets P can be fed in the direction of arrow B. By moving the pair of width-adjusting cursors 34*a* and 34*b* and the back-end cursor 33 according to the size of the sheet, the sheet stack S can be stored in the sheet feeding unit 130 at a predetermined position. The sheet feeding unit 130 includes a cassette cover 43. A front surface (the front side when viewed in the direction of arrow C in FIG. 4) of the cassette cover 43 is exposed to the outside and forms a part of the exterior surface of the color printer 1.

A lift mechanism 30 (FIG. 9), which lifts up the lift plate 31, is disposed below a downstream portion of the lift plate 31 with respect to the sheet feeding direction. The lift mechanism 30 includes a drive shaft 36, a lifting member 32, and a drive connection member (not shown). A receiving member (not shown) corresponding to the drive connection member and a lift motor M (FIG. 9) that is connected to the receiving member and rotatable in both directions is located on a sheet feeding unit body 130B. When the sheet feeding cassette 130A is inserted into the sheet feeding unit body 130B, the drive connection member of the sheet container 35 of the sheet feeding cassette 130A engages with the receiving member of the sheet feeding unit body 130B. Thus, the power of the lift motor M can be transmitted to the drive shaft 36. The drive shaft 36, the lifting member 32, the drive connection member, the receiving member, and the lift motor M constitute a lift mechanism that displaces the lift plate 31 between a sheet feed position and a retracted position. The term "sheet feed position" refers to a position at which the lift plate 31 is lifted up and the upper surface of the sheet stack S placed on the lift plate 31 contacts the pickup roller 40 so that a sheet can be fed out. The term "retracted position" refers to a position at which the lift plate 31 is lowered to the limit.

The type of the sheets P to be fed can be selected by using a sheet selecting unit (sheet identifying unit) 39. The sheet selecting unit 39 includes a plurality of operation keys and a display unit (both of which are not shown). The sheet selecting unit 39 can be disposed, for example, on an operation panel (not shown) of the sheet feeding unit 130 or of the printer body 200.

The lift motor M included in the lift mechanism 30 for lifting the lift plate 31 may be implemented as a stepping motor, a DC motor, or the like.

As shown in FIG. 3, the sheet feeding unit 130 includes a feed roller 41 disposed downstream of the pickup roller 40 with respect to the sheet feeding direction, and a separation roller 42 disposed below the feed roller 41. Moreover, a pair of conveying rollers 44 and 45 is disposed downstream of the pickup roller 40 and the feed roller 41 with respect to the sheet feeding direction. The feed roller 41, the pickup roller 40, and the conveying roller 44 are disposed on the sheet feeding unit body 130B, while the separation roller 42 and the conveying roller 45 are disposed on the sheet feeding cassette 130A. When the sheet feeding cassette 130A is loaded into the sheet feeding unit body 130B, the feed roller 41 contacts the separation roller 42.

The feed roller 41 serves to feed the sheet P that has been picked up with the pickup roller 40 to the pair of conveying rollers 44 and 45. The feed roller 41 rotates in a direction that allows the sheet P to be fed downstream. In contrast, the separation roller 42 rotates in a direction that allows the sheet P to be fed upstream. Even if a plurality of the sheets P have been picked up by the pickup roller 40 in an overlapping manner, the separation roller 42 prevents the sheet P that is not at the uppermost position from being fed toward the pair of conveying rollers 44 and 45 so that only the uppermost sheet P can be fed toward the pair of conveying rollers 44 and 45 by the feed roller 41. The pair of conveying rollers 44 and 45 conveys the sheet P to the sheet conveying path 133 (see FIG. 2).

As shown in FIGS. 5A and 5B, the sheet feeding unit 130 includes a first detecting sensor PS1 for detecting whether the uppermost sheet P of the sheet stack S placed on the lift plate 31 is at the sheet feed position. The first detecting sensor PS1 includes a light-shielding member PSA and an optical sensor PSB. The optical sensor PSB includes a light-emitting device fixed to a position near the pickup roller 40 and a light-receiving device for receiving light that is emitted from the light-emitting device. The light-shielding member PSA is disposed on a supporting member 50 that supports the pickup roller 40. The supporting member 50 is rotatable around the rotation axis of the feed roller 41. With this structure, when the lift plate 31 is lifted up, the upper surface of the sheet stack S placed on the lift plate 31 is moved to the sheet feed position shown in FIG. 5B. The pickup roller 40 is pushed up by the uppermost sheet P and rotated around the rotation axis of the feed roller 41, displacing slightly upward. At this time, the light-shielding member PSA is lifted up together with the pickup roller 40 so as to block the light path of the optical sensor PSB, thereby allowing the optical sensor to detect that the upper surface of the sheet stack S is at the sheet feed position.

In the sheet feeding unit 130, when the lift motor M is driven, the lifting member 32 engages with the bottom surface of the lift plate 31 and lifts up a downstream end of the lift plate 31. Thus, the upper surface of the sheet stack S placed on the lift plate 31 is displaced to the sheet feed position at which the upper surface of the sheet stack S contacts the pickup roller 40 disposed in an upper part of the sheet feeding cassette 130A.

When the first detecting sensor PS1 detects that the pickup roller 40 has displaced to the sheet feed position as shown in FIG. 5B, the lift motor M is stopped. When the number of the sheets P decreases while the sheets P are being fed and the first detecting sensor PS1 enters a non-detection state, the lift motor M is driven so as to lift up the sheet stack S to the sheet feed position.

The sheet feeding unit 130 according to the embodiment further includes a second detection sensor PS2. The second detection sensor PS2 serves as a float amount detector for detecting a float amount by which the sheet P floats when warm air is blown toward the sheet P from a first warm-air outlet 155 of a side warm-air mechanism 150. A sensor such as a reflective photosensor or an ultrasonic sensor can be used as the second detection sensor PS2. A reflective photosensor can detect the float amount by irradiating a surface of the sheet P serving as a reflection surface with light from a light source such as an LED and by detecting reflected light from the surface of the sheet P with a light-receiving device such as a photodiode. An ultrasonic sensor can detect the float amount by measuring an interval between the time when sound is emitted and the time when the sound that has been reflected by a surface of the sheet P serving as a reflection surface returns to the sensor.

As described below, detection results obtained by the first detecting sensor PS1 and the second detection sensor PS2 are output to a controller 300. The sheet feeding unit 130 according to the embodiment appropriately controls the sheet separating operation corresponding to the float amount of the sheet P detected by the second detection sensor PS2 while continuous feeding is being performed.

For example, in a case in which the sheets P to be continuously fed are a paper type such an art paper or a coated paper having a high inter-sheet adhesion or one having a weight equal to or greater than 100 g, the float amount of the sheet P when the side warm-air mechanism 150 blows warm air toward the sheet P is smaller than the case in which the sheets P are a plain paper having a low inter-sheet adhesion. Under a high-humidity environment (of a humidity equal to or greater than 50%), inter-sheet adhesion is high for the same type of sheets P. Thus, even if a warm air blowing operation is performed in the same manner, the float amount of the sheets P varies corresponding to the type of the sheets P to be fed and the difference in the environment.

Therefore, by changing the frequency with which the sheet separating operation is performed corresponding to the float amount of the sheets P being fed, it is possible to efficiently prevent jamming of the sheets P without significantly decreasing a continuous sheet feeding speed.

As shown in FIGS. 2, 3, 6, and 7, the sheet feeding unit 130 according to the embodiment includes the side warm-air mechanism (warm-air mechanism) 150 serving as a sheet separation mechanism that utilizes blowing of warm air.

FIG. 6 is an explanatory view showing a structure of a sheet feeder according to the embodiment of the present invention. FIG. 7 is a horizontal sectional view of a main part of the side warm-air mechanism incorporated in the sheet feeder according to the embodiment.

The side warm-air mechanism 150 is disposed on the sheet feeding unit body 130B. As shown in FIG. 6, a top panel 56 is formed on top of the sheet feeding unit body 130B in an area in which the side warm-air mechanism 150 and an upper warm-air mechanism (second warm-air mechanism) 140 described below are not disposed. The top panel 56 covers a sheet containing space.

As shown in FIG. 6, the side warm-air mechanism 150 is disposed on a side of the sheet feeding cassette 130A parallel to the sheet feeding direction. As shown in FIG. 7, the side warm-air mechanism 150 includes a first fan (an air blowing section) 151 and a first heater (a heating section) 152, both of which are disposed in a side warm-air chamber 153.

As shown in FIG. 7, the side warm-air mechanism 150 draws air from the sheet feeding unit 130 through a first inlet (an air blowing section) 154 disposed in the sheet feeding unit 130. When the first fan 151 rotates and air in the side warm-air chamber (air blowing section) 153 is moved toward the first heater 152, air is drawn in from the sheet feeding unit 130 through the first inlet 154 to the side warm-air chamber 153. Air that has been moved to the first heater 152 is heated with the first heater 152, and blown toward a side surface of the sheet stack S through a first warm-air outlet (outlet, air blowing section) 155.

The first warm-air outlet 155 of the side warm-air mechanism 150 from which warm air is blown toward a side surface of the sheet stack S at the sheet feed position is oriented toward a point N, which is shown in FIG. 5B on a sectional plane parallel to the sheet feeding direction, at which the pickup roller 40 contacts the upper surface of the sheet stack S. With this structure, the warm air can be intensively blown toward the side surface of the sheet stack S at a position at which a sheet is picked up by the pickup roller 40, so that air can be efficiently blown into spaces between the sheets. Thus, even if the side warm-air mechanism 150 is not large, the sheet stack S can be efficiently separated before feeding.

As shown in FIGS. 2, 3, 6, and 8, the sheet feeding unit 130 according to the embodiment includes the upper warm-air mechanism 140 serving as a sheet separation mechanism that utilizes blowing of warm air, in addition to the side warm-air mechanism 150.

FIG. 8 is a vertical sectional view of a main part of the upper warm-air mechanism incorporated in the sheet feeder according to the embodiment.

As with the above-described side warm-air mechanism 150, the upper warm-air mechanism 140 is disposed on the sheet feeding unit body 130B. As shown in FIG. 8, the upper warm-air mechanism 140 draws air in through a second inlet (air blowing section) 144 and blows the warm air toward the upper surface of the sheet stack S contained in the sheet container 35 through a second warm-air outlet (air blowing section) 145 disposed above the upper surface of the sheet stack S.

The upper warm-air mechanism 140 includes a second fan (air blowing section) 141 and a second heater (a heating section) 142 in an upper warm air chamber (an air blowing section) 143. The second inlet 144 is formed in an upper surface of the upper warm air chamber 143 above the second fan 141. When the second fan 141 rotates and air in the upper warm air chamber 143 is moved toward the second heater 142, outside air is drawn into the upper warm air chamber 143 through the second inlet 144. Air that has been moved to the second heater 142 is heated with the second heater 142, and blown toward the upper surface of the sheet stack S through the second warm-air outlet 145 disposed in a lower surface of the upper warm air chamber 143. The upper warm-air mechanism 140 is attached to the sheet feeding unit 130 such that the second warm-air outlet 145 is positioned in a downstream portion of the upper warm-air mechanism 140 with respect to the sheet feeding direction.

With the above described structure, when a specific sheet feeding unit 130 is selected for image formation, the lift plate 31 is moved upward so that the sheet stack S is lifted toward the pickup roller 40. Then, the upper warm-air mechanism 140 is driven so that the warm air is blown toward the upper surface of the sheet stack S through the second warm-air outlet 145.

The upper surface and the outer periphery of the sheet stack S is prone to absorbing moisture because the upper surface and the outer periphery are in contact with outside air. Thus, the upper surface and the side surfaces of the sheet stack S absorb moisture and swell, while the inside of the sheet stack swells to a lesser extent because the inside absorbs less moisture than the upper surface and the side surfaces. As a result, inner spaces (spaces between sheets) of the sheet stack S enter a negative pressure state, which causes the sheets to adhere to each other.

However, since the sheet feeding unit 130 according to the embodiment includes the upper warm-air mechanism 140, the relative humidity (the relative humidity on the upper surface and the outer periphery of the sheet stack) of the sheet stack S in the sheet feeding unit 130 can be instantaneously decreased.

That is, the upper warm-air mechanism 140 can intensively and uniformly blow air toward the upper surface and the outer periphery of the sheet stack S, where adhesion is particularly high. Thus, the moisture of the upper side and the outer periphery of the sheet stack S can be rapidly reduced so as to reduce swelling of these parts, whereby the relative humidity (humidity of the upper surface and the outer periphery of the sheet stack S) can be instantaneously decreased and the negative pressure state in the inner spaces (spaces between sheets) of the sheet stack S can be released. Therefore, inter-sheet adhesion can be reduced, so that the sheet stack S can be efficiently separated before feeding.

As shown in FIG. 3, the upper warm-air mechanism 140 according to the embodiment is disposed upstream of the pickup roller 40 with respect to the sheet feeding direction and in a rear portion of the sheet feeding unit 130 with respect to the sheet feeding direction. Since the second warm-air outlet 145 is disposed in a downstream portion of the upper warm-air mechanism 140 with respect to the sheet feeding direction as described above, the warm air can be efficiently blown toward the upper surface of the sheet stack S contained in the sheet container 35 through the second warm-air outlet 145. By thus disposing the upper warm-air mechanism 140 having a high sheet-separation efficiency by utilizing an unused space in the sheet feeding unit 130, a sheet separation mechanism that uses a warm-air assist and is applicable to a small sheet feeder can be realized.

Referring to FIGS. 9 to 14, a control process of a sheet separating operation according to an embodiment for warm air blowing is described.

FIG. 9 is a functional block diagram of a controller according to an embodiment of the present invention. The controller controls a warm-air blowing operation including a separating operation. FIGS. 10 and 11 are flowcharts showing a control process exercised by the controller shown in FIG. 9. FIGS. 12 to 14 are longitudinal sectional views of a main part of a sheet feeding unit according to an embodiment, where FIG. 12 shows a state in which the sheet stack is being separated with blowing of warm air at the sheet feed position, FIG. 13 shows a state in which the sheet stack is being separated with blowing of warm air at a separation position, and FIG. 14 shows a state in which some sheets (those having high inter-sheet adhesion in an upper part of the sheet stack) float while adhering to each other.

As described below, the sheet feeding unit 130 according to the embodiment can perform an intermittent sheet separating operation in which a sheet separating operation is performed every time a predetermined number (for example, ten) of the sheets P are fed during a continuous feeding operation.

Since the sheets P are separated every time a predetermined number of the sheets P are fed, the sheet separation mechanism effectively prevents the sheets P from jamming even when a large number of the sheets P like art paper or coated paper having a high inter-sheet adhesion, for which prevention of double feeding is particularly difficult, are continuously fed.

First, referring to the functional block diagram of FIG. 9 and the flow chart of FIG. 10, a sheet separating operation according to the embodiment is described.

The sheet feeding unit 130 includes the controller 300 that controls the lift mechanism 30 so as to perform a sheet separating operation in which the lift plate 31 is displaced so that a position on a side surface of the sheet stack S, the side surface being parallel to the sheet feeding direction, toward which warm air is blown from the first warm-air outlet (outlet) 155 of the side warm-air mechanism 150 is changed. The controller 300 controls the lift mechanism 30 so that the sheet separating operation is performed every time a predetermined number (for example, ten) of the sheets P are continuously fed during a continuous feeding operation.

As shown in the functional block diagram of FIG. 9, the controller 300 includes an I/O unit 85, a warm-air controller 90, a lift mechanism controller 80, and a memory unit 84.

Signals input to the I/O unit 85 includes a sheet type signal from the sheet selecting unit 39, a position detection signal from the first detecting sensor PS1, a light detection signal from the second detection sensor PS2, a first timeout signal from a first timer 86, a second timeout signal from a second timer 87, an output signal from a first counter 88, an output signal from a second counter 89, a humidity signal from a humidity sensor HS, a warm-air request signal and a sheet feed command signal from a CPU 210 of the printer body 200.

The warm-air controller 90 controls driving of the side warm-air mechanism 150 and the upper warm-air mechanism 140 corresponding to the sheet feed command signal and the warm-air request signal. In response to these input signals, the warm-air controller 90 outputs a control signal for driving the side warm-air mechanism 150 and the upper warm-air mechanism 140 to driving motors and heaters (not shown) of the warm-air mechanisms 140 and 150 through the I/O unit 85.

The lift mechanism controller 80 includes a downward-drive determining section 82 and an upward-drive determining section 83. The lift mechanism controller 80 controls the lifting movement of the lift mechanism 30 corresponding to the first timeout signal from the first timer 86, the second timeout signal from the second timer 87, the output signal from the first counter 88, and the output signal from the second counter 89, so that the lift mechanism 30 repeats a separating operation in which the lift plate 31 is moved between the sheet feed position and the separation position.

The downward-drive determining section 82 outputs a control signal for downwardly driving the lifting member 32 through the I/O unit 85 to the lift motor M corresponding to the sheet type signal and the first timeout signal.

The upward-drive determining section 83 outputs a control signal for driving the lift plate 31 upward using the lifting member 32 through the I/O unit 85 to the lift motor M corresponding to the sheet feed command signal and the second timeout signal.

The memory unit 84 stores, for example, a first timeout value for the first timer 86 and a second timeout value for the second timer 87 corresponding to the type of the sheets P selected with the sheet selecting unit 39, an output signal from the first counter 88, an output signal from the second counter 89, and operation programs for the controllers. Moreover, the memory unit 84 includes a storage area for temporarily storing a determination result—and other data.

The controller 300 can be constituted by, for example, a CPU, a memory (ROM, RAM, etc.), an input interface, and an output interface.

In the embodiment, the type of the sheets P can be selected with the sheet selecting unit 39. However, the present invention is not limited thereto. For example, the type of the sheets P to be fed may be determined by using a reflective photosensor, which irradiates a surface of the sheets P serving as a reflection surface with light from a light source such as an LED and detects reflected light from the surface of the sheets P with a light-receiving device such as a photodiode.

Referring to the flowchart of FIG. 10, a control process of the sheet separating operation of the controller 300 according to the embodiment is described.

First, when the sheet feeding cassette 130A is loaded into the color printer 1 (S1), the upward-drive determining section 83 of the lift mechanism controller 80 outputs a control signal for upwardly driving the lift plate 31 with the lifting member 32 through the I/O unit 85 to the lift motor M and the upward drive of the lift plate 31 (S2) starts.

When it is determined that the lift plate 31 has lifted up to the sheet feed position on the basis of a position detection signal from the first detecting sensor PS1 (FIG. 5) (S3), the upward-drive determining section 83 stops the lift motor M, whereby the upward drive of the lift plate 31 is stopped (S4). The control process is held in a standby state in this feed position until a sheet feed command is issued.

When a control signal corresponding to the continuous feeding number (for example, 100 sheets) that a user has set with the operation panel and the type of the sheets to be fed that has been selected with the sheet selecting unit 39 is input through the I/O unit 85, a sheet feed preparation period is started (S5). At the same time, on the basis of a sheet feed command signal and a warm-air request signal, the warm-air controller 90 outputs control signals through the I/O unit 85 to the first fan 151 and the first heater 152 of the side warm-air mechanism 150 and to the second fan 141 and the second heater 142 of the upper warm-air mechanism 140 so as to drive the heaters and the fans (S6).

Next, the downward-drive determining section 82 starts a downward drive of the lift plate 31 and reads from the memory unit 84 the data for a downward drive period as a first predetermined period, which corresponds to the selected type of the sheets P, on the basis of the sheet type signal from the sheet selecting unit 39, and starts the first timer 86 (S7). Then, the downward-drive determining section 82 continues the downward drive of the lift plate 31 for the first predetermined period.

That is, the downward-drive determining section 82 determines whether the first predetermined period has elapsed on the basis of the first timeout signal from the first timer 86 (S8). If it is determined that the first predetermined period has elapsed on the basis of the first timeout signal (when the determination in S8 is "YES"), the downward-drive determining section 82 stops the lift motor M so as to stop the downward drive of the lift plate 31 (S9).

Next, the upward-drive determining section 83 determines whether the second predetermined period has elapsed on the basis of the second timeout signal from the second timer 87 (S10). The second timer 87 continues to keep time until the second predetermined period elapses, while the lift plate 31 is held in the separation position. On the other hand, if it is determined that the second predetermined period has elapsed on the basis of the second timeout signal (when the determination in S10 is "YES"), the upward-drive determining section 83 outputs a control signal for upwardly driving the lift plate 31 with the lifting member 32 through the I/O unit 85 to the lift motor M. Thus, the lift motor M is driven and an upward drive of the lifting member 32 is started (S11).

Next, when it is detected that the upward drive of the lift plate 31 with the lifting member 32 to the sheet feed position has finished on the basis of the position detection signal from the first detecting sensor PS1, the upward-drive determining section 83 stops the lift motor M (stops the upward drive) (S12).

If a predetermined number of separating operations have not finished (when the determination in S13 is "NO"), the separating operation (S7 to S12), with which the lift plate 31 is moved up and down between the sheet feed position (FIG. 12) and the separation position (FIGS. 13 and 14), is repeated.

If a predetermined number of separating operations have finished (if the determination in S13 is "YES"), a continuous feeding operation including an intermittent sheet separating operation is started (S14).

The embodiment includes the side warm-air mechanism 150 and the upper warm-air mechanism 140. However, needless to say, the present invention is applicable to a structure including only the side warm-air mechanism 150. Moreover, for example, the upper warm-air mechanism 140 may be used only when the sheets P to be continuously fed are made of paper such as art paper or coated paper having a high inter-sheet adhesion.

In the embodiment, even after the continuous feeding operation is started, the steps S6 to S13 are performed as an intermittent sheet separating operation every time a predetermined number of sheets P are continuously fed.

Referring to the flowcharts of FIGS. 10 and 11, a control process of the continuous feeding operation including the intermittent sheet separating operation is described below.

When a predetermined number of separating operations have finished and the sheet feed preparation period has ended as shown in FIG. 10, continuous sheet feeding is started as shown in FIG. 11 (S20). Then, until a predetermined number (for example, a hundred) of sheets have been continuously fed, the first counter 88 counts up the number of sheets every time a sheet is fed, and the continuous feeding is performed until the number of sheets reaches a hundred, which is the final count at which the continuous feeding finishes (when the determination in S21 is "YES").

In the embodiment, until the continuous feeding of a hundred sheets P finishes, the lift mechanism 30 is controlled such that the sheet separating operation is performed every time a predetermined number (for example, ten) of the sheets P are continuously fed.

That is, from the time when the continuous feeding is started in S20 to the time when a predetermined number (ten) of the sheets P have been continuously fed, the continuous feeding is continued (steps S20 to S22 are repeated until the determination in S22 becomes "YES"). When the continuous feeding of the predetermined number (ten) of sheets finishes (when the determination in S22 becomes "YES"), a sheet separating operation is performed (S23).

Thus, in step S23, a sheet separating operation including the steps S6 to S13 shown in the flowchart of FIG. 10 is performed. When the sheet separating operation in step S23 finishes, a continuous feeding is started again (S20).

In such a manner, until a continuous feeding of a predetermined number (a hundred) of sheets finishes, the sheet separating operation of step S23 is intermittently inserted into the continuous feeding operation when the number of sheets that have been continuously fed becomes ten, twenty, thirty, . . . , ninety.

As described above, the sheet feeding unit 130 according to the embodiment includes the lift plate 31 on which the sheet stack S of a plurality of the sheets P are placed, a sheet feed mechanism being capable of performing a continuous sheet feeding operation starting from an uppermost sheet P in the sheet stack S placed on the lift plate 31, the side warm-air mechanism 150 that blows air toward a side surface of the sheet stack S from the first warm-air outlet 155, the side surface being parallel to a sheet feeding direction, a lift mechanism 30 that displaces the lift plate 31, and the controller 300 that controls the lift mechanism 30 so as to perform a sheet separating operation in which the lift plate 31 is displaced so that a position on the side surface of the sheet stack S toward which warm air is blown from the first warm-air outlet 155 is changed, the side surface being parallel to the sheet feeding direction. The controller 300 controls the lift mechanism 30 so as to perform the sheet separating operation every time a predetermined number of the sheets P are fed during the continuous sheet feeding operation.

With this structure, an intermittent sheet separating operation, in which the sheet separating operation is performed every time a predetermined number of the sheets P are continuously fed, is performed during the continuous feeding operation.

Thus, for example, even when the sheets P made of paper, such as art paper or coated paper, having a high inter-sheet adhesion and for which prevention of double feeding is particularly difficult, are continuously fed, the sheets P can be separated every time a predetermined number of the sheets P are fed. Therefore, the sheet feeding unit 130 including the sheet separation mechanism can securely prevent sheet jamming.

Moreover, it is preferable that the sheet feeding unit 130 further includes the sheet identifying unit 39 that identifies a type of the sheets P to be fed, with the controller 300 determining whether or not to perform the sheet separating operation corresponding to the type of the sheets P identified by the sheet identifying unit 39.

With this structure, control can be performed so that the sheet separating operation takes place, for example, when the sheets P to be continuously fed are made of paper such as art paper or coated paper having a high inter-sheet adhesion or made of paper having a weight equal to or greater than 100 g, while the sheet separating operation does not take place when the sheets P are made of paper having a low inter-sheet adhesion such as plain paper. In this case, the sheet separating operation is performed with a minimal frequency. Therefore, jamming of the sheets P can be efficiently prevented without excessively reducing the speed of continuous feeding.

Moreover, it is preferable that the controller 300 changes the predetermined number corresponding to the type of the sheets P identified by the sheet identifying unit 39 and performs the sheet separating operation.

With this structure, even if the same number (for example, a hundred) of the sheets P are to be continuously fed, control can be performed in such a manner that, when the sheets P are made of paper such as plain paper having a low inter-sheet adhesion, the sheet separating operation is performed every time twenty sheets are fed. Conversely, when the sheets P are made of paper such as art paper or coated paper having a high inter-sheet adhesion or made of paper having a weight equal to or greater than 100 g, the sheet separating operation is performed every time ten sheets are fed.

By changing the frequency of performing the sheet separating operation corresponding to the type of the sheets P to be fed, jamming of the sheets P can be efficiently prevented without excessively reducing the speed of continuous feeding.

It is preferable that the sheet feeding unit 130 according to the embodiment further include the second detection sensor SP2 that detects a float amount by which the sheets P float when warm air is blown from the first warm-air outlet 155 of the side warm-air mechanism 150, with the controller 300 determining whether or not to perform the sheet separating operation corresponding to the float amount of the sheets P detected by the second detection sensor SP2.

With this structure, for example, when the sheets P to be fed are made of paper such as plain paper having a low inter-sheet adhesion and the second detection sensor PS2 detects that the sheets P have sufficiently floated due to blowing of warm air, the intermittent sheet separating operation can be omitted.

By thus performing the sheet separating operation only in case of necessity, jamming of the sheets P can be efficiently prevented without excessively reducing the speed of continuous feeding.

For example, when the sheets P to be continuously fed are made of paper such as art paper or coated paper having a high inter-sheet adhesion or made of paper having a weight equal to or greater than 100 g, the floating amount of the sheets P due to blowing of warm air by the side warm-air mechanism 150 is smaller than the floating amount in the case when the sheets P are made of paper such as plain paper having a low inter-sheet adhesion. For the same type of sheets P, inter-sheet adhesion is high under a high-humidity environment (for example, in an environment of a humidity equal to or greater than 50% RH). Therefore, even if the same warm air blowing operation is performed, a floating amount of the sheets P may differ corresponding to the type of the sheets P to be fed and the difference in environment.

With the above-described structure, even if the same number (for example, a hundred) of the sheets P are to be continuously fed, the controller can control in such a manner that, when it is detected that the sheets P have floated by a sufficient floating amount due to blowing of warm air, the sheet separating operation is not performed during the continuous feeding operation, and when the floating amount is insufficient, the sheet separating operation is performed during the continuous feeding operation.

By thus changing the frequency for performing the sheet separating operation corresponding to the floating amount of the sheets P to be fed, jamming of the sheets P can be efficiently prevented without excessively reducing the speed of continuous feeding.

The control may be performed in such a manner that the sheet separating operation takes place during the continuous feeding operation only when, for example, humidity equal to or greater than 50% RH is observed on the basis of the humidity signal from the humidity sensor HS.

In the above-described structure, the controller may change the predetermined number corresponding to the float amount of the sheets P detected by the second detection sensor PS2 and carry out the control so as to perform the sheet separating operation.

For example, a float amount of the sheets P due to blowing of warm air during the sheet feed preparation period may be detected by the second detection sensor PS2, and the controller 300 may change the predetermined number on the basis of the detection by the second detection sensor PS2 corresponding to the float amount of the sheets P and may perform the sheet separating operation.

For example, when the sheets P to be continuously fed are made of paper such as art paper or coated paper having a high inter-sheet adhesion or made of paper having a weight equal to or greater than 100 g, the floating amount of the sheets P due to blowing of warm air by the side warm-air mechanism 150 is smaller than the floating amount in the case when the sheet P is made of paper such as plain paper having a low inter-sheet adhesion. For the same type of sheets P, the inter-sheet adhesion is high under a high-humidity environment (for example, in an environment of a humidity equal to or greater than 50% RH). Therefore, even if the same warm air blowing operation is performed, floating amount of the sheets P may differ corresponding to the type of the sheets P to be fed and the difference in environment.

With this structure, for example, even if the same number (for example, a hundred) of the sheets P are to be continuously fed, control can be performed in such a manner that, when the floating amount of the sheets P is large, the sheet separating operation is performed, for example, every time twenty sheets are fed, and, when the floating amount of the sheets P is small, the sheet separating operation is performed every time ten sheets are fed.

By thus changing the frequency for performing the sheet separating operation corresponding to the floating amount of the sheets P to be fed, jamming of the sheets P can be efficiently prevented without excessively reducing the speed of continuous feeding.

The sheet feeder according to the embodiments of the present invention can be applied to various image forming apparatuses including printers, copiers, fax machines, and multi-functional peripherals having these functions. In particular, the sheet feeder is suitable for small image forming apparatuses.

What is claimed is:

1. A sheet feeder with side surface air mechanism comprising:

a sheet loading plate configured to store a stack of recording sheets thereon;

a sheet feed mechanism configured to perform a continuous sheet feeding operation from an uppermost sheet in the stack;

a heated-air mechanism configured to blow heated air toward a side surface of the stack from an air outlet, the side surface being parallel to a sheet feeding direction;

a lift mechanism configured to displace the sheet loading plate toward and away from a sheet feed position at which the uppermost sheet in the stack contacts the sheet feed mechanism; and a controller configured to control a sheet separating operation after a predetermined number of the sheets are fed during the continuous sheet feeding operation, the sheet separating operation including, while causing the heated air mechanism to blow heated air toward the side surface of the sheet stack, (i) causing the lift mechanism to displace the sheet loading plate away from the sheet feed position for a first predetermined period, (ii) causing the lift mechanism to maintain its position for a second predetermined period, and (iii) causing the lift mechanism to displace the sheet loading plate towards the sheet feed position.

2. The sheet feeder with side surface air mechanism according to claim 1, further comprising a sheet identifying unit configured to identify a type of the sheet to be fed, wherein the controller determines that the controller should perform the sheet separating operation corresponding to the type of the sheet identified by the sheet identifying unit.

3. The sheet feeder with side surface air mechanism according to claim 1, further comprising a sheet identifying unit configured to identify a type of the sheet to be fed, wherein the controller changes the predetermined number corresponding to the type of the sheet identified by the sheet identifying unit.

4. The sheet feeder with side surface air mechanism according to claim 1, further comprising a float amount detector that detects a float amount of the sheets as floated by the heated air blown from the air outlet, wherein the controller determines that the controller should perform the sheet separating operation corresponding to the float amount of the sheets detected by the float amount detector.

5. The sheet feeder with side surface air mechanism according to claim 1, further comprising a float amount detector that detects a float amount of the sheets as floated by the heated air blown from the air outlet, wherein the controller changes the predetermined number corresponding to the float amount of the sheets detected by the float amount detector.

6. The sheet feeder with side surface air mechanism according to claim 1, wherein the lift mechanism comprises a lifting member configured to lift up the sheet loading plate, wherein the sheet loading plate is rotatably supported at a first end thereof, the first end being at an upstream side of the sheet loading plate with respect to the sheet feeding direction, and wherein the lifting member is configured such that a second end thereof is rotatably supported by a drive shaft and a third end thereof contacts the bottom surface of the sheet loading plate so as to lift up the sheet loading plate.

7. The sheet feeder with side surface air mechanism according to claim 1, wherein the controller is configured to perform the sheet separation operation after every multiple number of predetermined sheets are fed during the continuous sheet feeding operation.

8. An image forming apparatus with side surface air mechanism comprising:

a sheet feeder, wherein the sheet feeder includes:

a sheet loading plate configured to store a stack of sheets thereon;

a sheet feed mechanism configured to perform a continuous sheet feeding operation from an uppermost sheet in the stack;

a heated air mechanism configured to blow air toward a side surface of the stack from an air outlet, the side surface being parallel to a sheet feeding direction;

a lift mechanism configured to displace the sheet loading plate toward and away from a sheet feed position at which the uppermost sheet in the stack contacts the sheet feed mechanism;

an image forming element that forms images on sheets fed by the sheet feeder operation from; and a controller configured to control a sheet separating operation after a predetermined number of the sheets are fed during the continuous sheet feeding operation, the sheet separating operation including, while causing the heated air mechanism to blow heated air toward the side surface of the sheet stack, (i) causing the lift mechanism to displace the sheet loading plate away from the sheet feed position for a first predetermined period, (ii) causing the lift mechanism to maintain its position for a second predetermined period, and (iii) causing the lift mechanism to displace the sheet loading plate towards the sheet feed position.

9. The image forming apparatus with side surface air mechanism according to claim 8, wherein the sheet feeder further comprises a sheet identifying unit configured to identify a type of the sheet to be fed, wherein the controller changes the predetermined number corresponding to the type of the sheet identified by the sheet identifying unit.

10. The image forming apparatus with side surface air mechanism according to claim 8, wherein the sheet feeder further comprises a float amount detector configured to detect a float amount of the sheets as floated by the heated air blown from the air outlet, wherein the controller determines that the controller should perform the sheet separating operation corresponding to the float amount of the sheets detected by the float amount detector.

11. The image forming apparatus with side surface air mechanism according to claim 8, wherein the sheet feeder further comprises a float amount detector configured to detect a float amount of the sheets as floated by the heated air blown from the air outlet, wherein the controller changes the predetermined number corresponding to the float amount of the sheets detected by the float amount detector.

12. The image forming apparatus with side surface air mechanism according to claim 8, wherein the lift mechanism comprises a lifting member configured to lift up the sheet loading plate, wherein the sheet loading plate is rotatably supported at a first end thereof, the end being at an upstream side of the sheet loading plate with respect to the sheet feeding direction, and wherein the lifting member is configured such that a second end thereof is rotatably supported by a drive shaft and a third end thereof contacts the bottom surface of the sheet loading plate so as to lift up the sheet loading plate.

13. The image forming apparatus with side surface air mechanism according to claim 8, wherein the sheet feeder further comprises a sheet identifying unit configured to identify a type of the sheet to be fed, wherein the controller determines that it that the controller should perform the sheet separating operation corresponding to the type of the sheet identified by the sheet identifying unit.

* * * * *